US009062528B2

(12) United States Patent
Mitchell et al.

(10) Patent No.: US 9,062,528 B2
(45) Date of Patent: Jun. 23, 2015

(54) SYSTEMS, METHODS, AND DEVICES FOR PREDICTING BOREHOLE GEOMETRY

(75) Inventors: Ian David Campbell Mitchell, Spring, TX (US); Michael John McLeod Strachan, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 460 days.

(21) Appl. No.: 13/515,339

(22) PCT Filed: Jun. 14, 2011

(86) PCT No.: PCT/US2011/040333

§ 371 (c)(1),
(2), (4) Date: Jun. 12, 2012

(87) PCT Pub. No.: WO2012/173601

PCT Pub. Date: Dec. 20, 2012

(65) Prior Publication Data

US 2012/0330551 A1 Dec. 27, 2012

(51) Int. Cl.
*E21B 47/022* (2012.01)

(52) U.S. Cl.
CPC ..... *E21B 47/022* (2013.01)

(58) Field of Classification Search
CPC . E21B 47/02; E21B 47/022; E21B 47/02208; E21B 47/02216; E21B 47/02224
USPC ..... 702/6–10, 151, 152, 154; 175/24, 45
See application file for complete search history.

(56) References Cited

U.S. PATENT DOCUMENTS

| | | | | |
|---|---|---|---|---|
| 7,106,210 | B2 | 9/2006 | Golla et al. | |
| 7,546,209 | B2 * | 6/2009 | Williams | 702/9 |
| 2008/0275648 | A1 * | 11/2008 | Illfelder | 702/7 |
| 2009/0120690 | A1 | 5/2009 | Phillips | |
| 2009/0157319 | A1 | 6/2009 | Mitchell | |
| 2009/0205867 | A1 | 8/2009 | Reckmann et al. | |
| 2009/0319241 | A1 | 12/2009 | Samuel | |

(Continued)

OTHER PUBLICATIONS

International Search Report corresponding to co-pending International Patent Application Serial No. PCT/US2011/040333, European Patent Office, dated Mar. 16, 2011; (4 pages).

(Continued)

*Primary Examiner* — Manuel L Barbee
(74) *Attorney, Agent, or Firm* — Chamberlain Hrdlicka

(57) ABSTRACT

System, methods and devices for measuring and predicting complex borehole geometries are presented herein. A method is disclosed for determining a trajectory of a borehole that is generated by a drill string. The method includes: receiving data indicative of one or more drilling parameters between at least two survey points; averaging the received data over predetermined increments between the at least two survey points; calculating from at least the averaged data a predicted drill string response for each of the predetermined increments; determining from at least the predicted drill string response a change in inclination and azimuth for each of the predetermined increments; generating a predicted wellbore trajectory from the change in inclination and azimuth; comparing the predicted wellbore trajectory to a measured wellbore trajectory; and, if the comparison is favorable, determining a probable borehole position from the change in inclination and azimuth for each of the predetermined increments.

20 Claims, 4 Drawing Sheets

(56) References Cited

U.S. PATENT DOCUMENTS

| | | | |
|---|---|---|---|
| 2010/0259415 | A1 | 10/2010 | Strachan et al. |
| 2011/0031023 | A1 | 2/2011 | Menezes et al. |

OTHER PUBLICATIONS

International Written Opinion corresponding to co-pending International Patent Application Serial No. PCT/US2011/040333, Eurpoean Patent Office, dated Mar. 16, 2011; (7 pages).

G.A. Bordakov et al.: Improving LWD Image and Formation Evaluation by Using Dynamically Corrected Drilling-Derived LWD Depth and Continuous Inclination and Azimuth Measurements; Dated Feb. 2009; (12 pages).

William G. Lesso, Jr. et al.: Continuous Direction and Inclination Measurements Revolutionize Real-Time Directional Drilling Decision-Making; Dated 2001: (15 pages).

S.J. Sawaryn et al.: A Compendium of Directional Calculations Based on the Minimum Curvature Method; Dated 2003; (16 pages).

S.J. Sawaryn et al.: A Compendium of Directional Calculations Based on the Minimum-Curvature Method—Part 2: Extension to Steering and Landing Applications; Dated 2009; (15 pages).

David C-K Chen et al.: State-of-the-Art BHA Program Produces Unprecedented Results; Dated 2008; (13 pages).

H.S. Williamson: Accuracy Prediction for Directional Measurement While Drilling; Dated Dec. 2000; (13 pages).

* cited by examiner

SYSTEMS, METHODS, AND DEVICES FOR PREDICTING BOREHOLE GEOMETRY

CLAIM OF PRIORITY AND CROSS-REFERENCE TO RELATED APPLICATION

This application is a U.S. National Phase of International Application No. PCT/US2011/040333, which was filed on Jun. 14, 2011, and is incorporated herein by reference in its entirety.

TECHNICAL FIELD

The present disclosure relates generally to the mapping and drilling of boreholes, and more particularly to systems and methods for measuring and predicting complex borehole geometry.

BACKGROUND

Boreholes, which are also commonly referred to as "wellbores" and "drill holes," are created for a variety of purposes, including exploratory drilling for locating underground deposits of different natural resources, mining operations for extracting such deposits, and construction projects for installing underground utilities. A common misconception is that all boreholes are vertically aligned with the drilling rig; however, many applications require the drilling of boreholes with vertically deviated and horizontal geometries. A well-known technique employed for drilling horizontal, vertically deviated, and other complex boreholes is directional drilling. Directional drilling is generally typified as a process of boring a hole which is characterized in that at least a portion of the course of the bore hole in the earth is in a direction other than strictly vertical—i.e., the axes make an angle with a vertical plane (known as "vertical deviation"), and are directed in an azimuth plane.

Conventional directional boring techniques traditionally operate from a boring device that pushes or steers a series of connected drill pipes with a directable drill bit at the distal end thereof to achieve the complex borehole geometry. In the exploration and recovery of subsurface hydrocarbon deposits, such as petroleum and natural gas, the directional borehole is typically drilled with a rotatable drill bit that is attached to one end of a bottom hole assembly or "BHA." A steerable BHA can include, for example, a positive displacement motor (PDM) or "mud motor," drill collars, reamers, shocks, and underreaming tools to enlarge the wellbore. A stabilizer may be attached to the BHA to control the bending of the BHA to direct the bit in the desired direction (inclination and azimuth). The BHA, in turn, is attached to the bottom of a tubing assembly, often comprising jointed pipe or relatively flexible "spoolable" tubing, also known as "coiled tubing." This directional drilling system—i.e., the operatively interconnected tubing, drill bit and BHA, can be referred to as a "drill string." When jointed pipe is utilized in the drill string, the drill bit can be rotated by rotating the jointed pipe from the surface, through the operation of the mud motor contained in the BHA, or both. In contrast, drill strings which employ coiled tubing generally rotate the drill bit via the mud motor in the BHA.

Irrespective of the well profile, whether it be horizontal, deviated, vertical, or any logical combination thereof, the wellbore trajectory must be mapped as precisely as possible to optimize harvesting of the hydrocarbon deposit. Historically, the path of a wellbore, or its "trajectory," is determined by collecting a series of direction and inclination ("D&I") measurements, such as inclination and azimuth, at discrete locations ("survey points") along the wellbore path. From these angular measurements, in conjunction with the known length of the drill string, a theoretical model of the wellbore trajectory can be constructed. Azimuth and inclination may be measured by survey sensors positioned along the drill string. These measurements can be affected by inadvertent changes in the drill string or drilling environment. For example, the part of the string to which the sensors are attached may bend or "sag," which can cause the borehole centerline to not necessarily point in the same direction as the centerline of the tool with the sensors.

Current practices in the drilling industry is to determine borehole position curvature by calculating the curvature between survey points (stations) as measured by a down hole survey instrument. The method most commonly used to define a well trajectory is called the Minimum Curvature Method, which is described, for example, by S. J. Sawaryn and J. L. Thorogood, in "A Compendium of Directional Calculations Based on the Minimum Curvature Method," SPE Annual Technical Conference and Exhibition, Denver, Colo., 5-8 Oct. (2003), which is incorporated herein by reference in its entirety. Using this methodology, the wellbore trajectory is represented by a series of tangent vectors that are connected by a circular arc. Collections of other points, lines and planes can be used to represent features, such as adjacent wells, lease lines, geological targets, and faults. The relationships between these objects have simple geometrical interpretations, making them amenable to mathematical treatment.

An accurate borehole position is important in determining the separation from other wells, the delineation of oil and gas fields, and calculation of the volumes of petroleum in a reservoir. During an actual drilling operation, the path taken by the drilling tools is not along a single constant curve but rather consists of a series of curves of varying degree. Variations in the wellbore trajectory between the survey points are not taken into consideration in the Minimum Curvature Method when calculating the wellbore position. As such, the current methods commonly used to define a well trajectory do not provide the most accurate borehole position and curvature. In addition, the misalignment of the drilling tools within the complex borehole shape is not taken into account when correcting misalignment of the measurements taken at the survey stations. Current practices typically correct for borehole misalignment based on minimum curvature borehole shape. Such practices are unsatisfactory to offset borehole misalignment.

There is therefore a need to better determine the path of the wellbore between the survey stations and too more accurately calculate the wellbore position.

SUMMARY

According to aspects of the present disclosure, a method for determining a trajectory of a borehole is presented. The method includes: receiving data indicative of one or more drilling parameters between at least two survey points; averaging the received data over predetermined increments between the at least two survey points; calculating from at least the averaged data a predicted drill string response for each of the predetermined increments; determining from at least the predicted drill string response a change in inclination and azimuth for each of the predetermined increments; generating a predicted wellbore trajectory from at least the change in inclination and azimuth; comparing the predicted wellbore trajectory to a measured wellbore trajectory; and, if the comparison is favorable, determining a probable borehole position from at least the change in inclination and azimuth for each of the predetermined increments.

According to other aspects of the present disclosure, a computer program product is disclosed, which comprises a non-transient computer readable medium having an instruction set borne thereby, the instruction set being configured to cause, upon execution by one or more controllers, the acts of: averaging a measured data set over predetermined increments between at least two survey points, the data set being indicative of a plurality of drilling parameters; calculating from at least the averaged data set a predicted drill string response for each predetermined increment; determining from at least the predicted drill string response a change in inclination and azimuth for each predetermined increment; generating a predicted wellbore trajectory from at least the change in inclination and azimuth; comparing the predicted wellbore trajectory to a measured wellbore trajectory; if the comparison is not favorable, recalculating the predicted drill string response by applying a correction factor with a statistical bias, and reiterating the acts of determining, generating, and comparing; and if the comparison is favorable, determining a probable borehole position from the change in inclination and azimuth for each predetermined increment.

According to other aspects of the present disclosure, a system for predicting a path of a complex borehole is featured. The borehole can be drilled by a directional drilling system having at least one sensing device that is operatively connected to a drill string, which has a bottom hole assembly (BHA) and a drill bit. The system includes an input device for receiving input(s) from a user, a controller, and a memory device storing a plurality of instructions. These instructions, when executed by the controller, cause the controller to: receive from the at least one sensing device measurements indicative of a plurality of drilling parameters between first and second survey points; average the received measurements over each of a plurality of user-defined depth increments between the first and second survey points; calculate from at least the averaged measurements a predicted BHA response and a predicted drill bit response for each of the depth increments; determine from at least the predicted BHA response and the predicted drill bit response a change in inclination and azimuth for each of the depth increments; generate a predicted wellbore trajectory at the first survey point from at least the change in inclination and azimuth; compare the predicted wellbore trajectory to a measured wellbore trajectory at the second survey point; and if the comparison is favorable, determine a probable borehole position from the change in inclination and azimuth for each of the depth increments.

The above summary is not intended to represent each embodiment or every aspect of the present disclosure. Rather, the foregoing summary merely provides an exemplification of some of the novel aspects and features set forth herein. The above features and advantages, and other features and advantages of the present disclosure, will be readily apparent from the following detailed description of the exemplary embodiments and best modes for carrying out the present invention when taken in connection with the accompanying drawings and appended claims.

Figure 1:
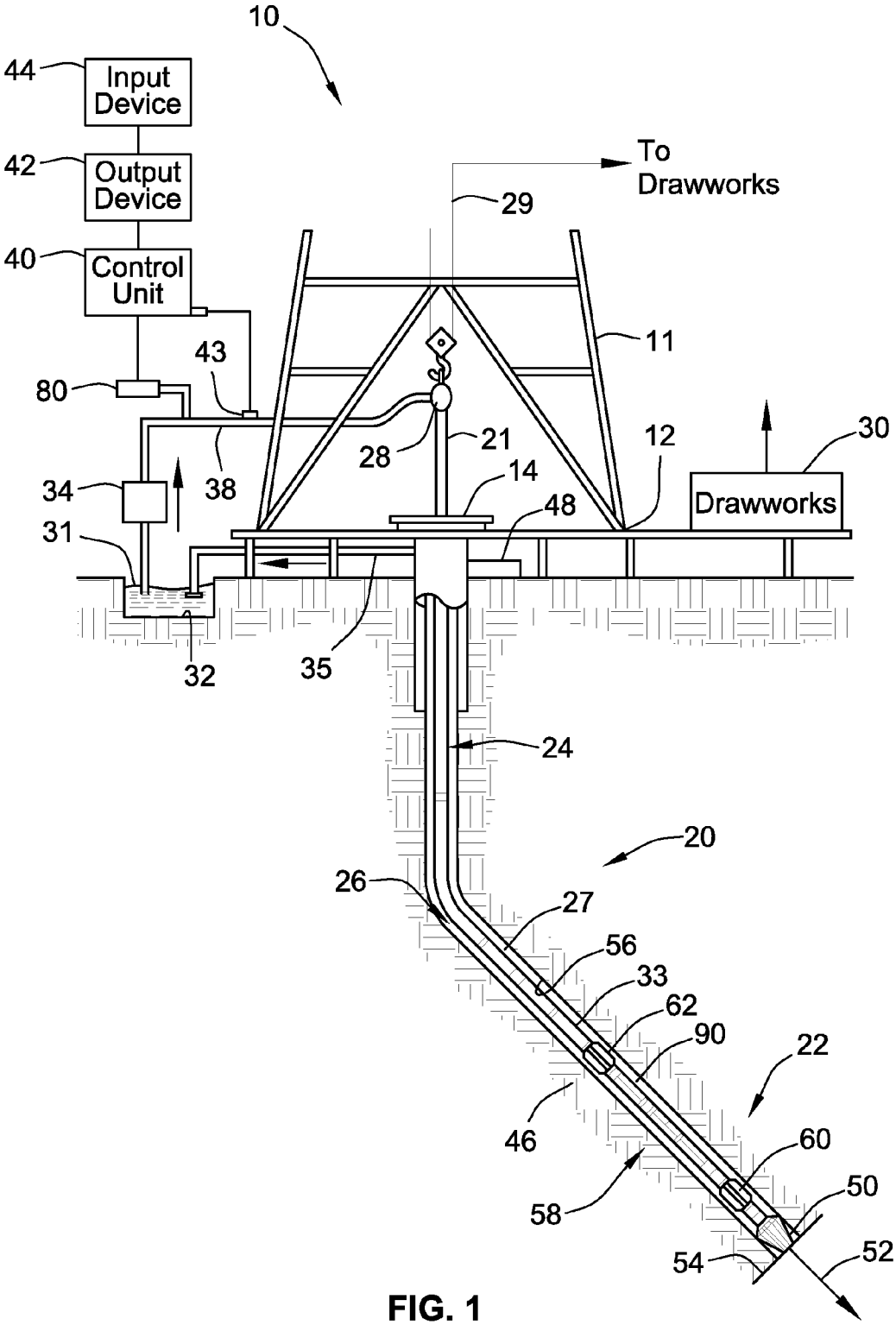
FIG. 1 is a schematic illustration of an exemplary drilling system in accordance with aspects of the present disclosure.

While the present disclosure is susceptible to various modifications and alternative forms, specific embodiments have been shown by way of example in the drawings and will be described in detail herein. It should be understood, however, that the disclosure is not intended to be limited to the particular forms disclosed. Rather, the disclosure is to cover all modifications, equivalents, and alternatives falling within the spirit and scope of the invention as defined by the appended claims.

DETAILED DESCRIPTION

This disclosure is susceptible of embodiment in many different forms. There are shown in the drawings and will herein be described in detail representative embodiments of the invention with the understanding that the present disclosure is to be considered as an exemplification of the principles of the invention and is not intended to limit the broad aspect of the invention to the embodiments illustrated.

Referring now to the drawings, wherein like reference numerals refer to like components throughout the several views, FIG. 1 illustrates an exemplary directional drilling system, designated generally as 10, in accordance with aspects of the present disclosure. Many of the disclosed concepts are discussed with reference to drilling operations for the exploration and recovery of subsurface hydrocarbon deposits, such as petroleum and natural gas. However, the disclosed concepts are not so limited, and can be applied to other drilling operations. To that end, the aspects of the present disclosure are not necessarily limited to the arrangement and components presented in FIGS. 1 and 2. In addition, it should be understood that the drawings are not necessarily to scale and are provided purely for descriptive purposes; thus, the individual and relative dimensions and orientations presented in the drawings are not to be considered limiting. Additional information relating to directional drilling systems can be found, for example, in U.S. Patent Application Publication No. 2010/0259415 A1, to Michael Strachan et al., which is entitled "Method and System for Predicting Performance of a Drilling System Having Multiple Cutting Structures" and is incorporated herein by reference in its entirety.

The directional drilling system 10 exemplified in FIG. 1 includes a tower or "derrick" 11, as it is most commonly referred to in the art, that is buttressed by a derrick floor 12. The derrick floor 12 supports a rotary table 14 that is driven at a desired rotational speed, for example, via a chain drive system through operation of a prime mover (not shown). The rotary table 14, in turn, provides the necessary rotational force to a drill string 20. The drill string 20, which includes a drill pipe section 24, extends downwardly from the rotary table 14 into a directional borehole 26. As illustrated in the Figures, the borehole 26 may travel along a multi-dimensional path or "trajectory." The three-dimensional direction of the bottom 54 of the borehole 26 of FIG. 1 is represented by a pointing vector 52.

A drill bit 50 is attached to the distal, downhole end of the drill string 20. When rotated, e.g., via the rotary table 14, the drill bit 50 operates to break up and generally disintegrate the geological formation 46. The drill string 20 is coupled to a "drawworks" hoisting apparatus 30, for example, via a kelly joint 21, swivel 28, and line 29 through a pulley system (not shown). The drawworks 30 may comprise various components, including a drum, one or more motors, a reduction gear, a main brake, and an auxiliary brake. During a drilling operation, the drawworks 30 can be operated, in some embodiments, to control the weight on bit 50 and the rate of penetration of the drill string 20 into the borehole 26. The operation of drawworks 30 is generally known and is thus not described in detail herein.

During drilling operations, a suitable drilling fluid (commonly referred to in the art as "mud") 31 can be circulated, under pressure, out from a mud pit 32 and into the borehole 26 through the drill string 20 by a hydraulic "mud pump" 34. The drilling fluid 31 may comprise, for example, water-based muds (WBM), which typically comprise a water-and-clay based composition, oil-based muds (OBM), where the base fluid is a petroleum product, such as diesel fuel, synthetic-based muds (SBM), where the base fluid is a synthetic oil, as well as gaseous drilling fluids. Drilling fluid 31 passes from the mud pump 34 into the drill string 20 via a fluid conduit (commonly referred to as a "mud line") 38 and the kelly joint 21. Drilling fluid 31 is discharged at the borehole bottom 54 through an opening in the drill bit 50, and circulates in an "uphole" direction towards the surface through an annular space 27 between the drill string 20 and the side of the borehole 26. As the drilling fluid 31 approaches the rotary table 14, it is discharged via a return line 35 into the mud pit 32. A variety of surface sensors 48, which are appropriately deployed on the surface of the borehole 26, operate alone or in conjunction with downhole sensors 70, 72 deployed within the borehole 26, to provide information about various drilling-related parameters, such as fluid flow rate, weight on bit, hook load, etc., which will be explained in further detail below.

A surface control unit 40 may receive signals from surface and downhole sensors and devices via a sensor or transducer 43, which can be placed on the fluid line 38. The surface control unit 40 can be operable to process such signals according to programmed instructions provided to surface control unit 40. Surface control unit 40 may present to an operator desired drilling parameters and other information via one or more output devices 42, such as a display, a computer monitor, speakers, lights, etc., which may be used by the operator to control the drilling operations. Surface control unit 40 may contain a computer, memory for storing data, a data recorder, and other known and hereinafter developed peripherals. Surface control unit 40 may also include models and may process data according to programmed instructions, and respond to user commands entered through a suitable input device 44, which may be in the nature of a keyboard, touchscreen, microphone, mouse, joystick, etc.

In some embodiments of the present disclosure, the rotatable drill bit 50 is attached at a distal end of a steerable drilling bottom hole assembly (BHA) 22. In the illustrated embodiment, the BHA 22 is coupled between the drill bit 50 and the drill pipe section 24 of the drill string 20. The BHA 22 may comprise a Measurement While Drilling (MWD) System, designated generally at 58 in FIG. 1, with various sensors to provide information about the formation 46 and downhole drilling parameters. The MWD sensors in the BHA 22 may include, but are not limited to, a device for measuring the formation resistivity near the drill bit, a gamma ray device for measuring the formation gamma ray intensity, devices for determining the inclination and azimuth of the drill string, and pressure sensors for measuring drilling fluid pressure downhole. The MWD may also include additional/alternative sensing devices for measuring shock, vibration, torque, telemetry, etc. The above-noted devices may transmit data to a downhole transmitter 33, which in turn transmits the data uphole to the surface control unit 40. In some embodiments, the BHA 22 may also include a Logging While Drilling (LWD) System.

In some embodiments, a mud pulse telemetry technique may be used to communicate data from downhole sensors and devices during drilling operations. Exemplary methods and apparatuses for mud pulse telemetry are described in U.S. Pat. No. 7,106,210 B2, to Christopher A. Golla et al., which is incorporated herein by reference in its entirety. Other known methods of telemetry which may be used without departing from the intended scope of this disclosure include electromagnetic telemetry, acoustic telemetry, and wired drill pipe telemetry, among others.

A transducer 43 placed in the mud supply line 38 detects the mud pulses responsive to the data transmitted by the downhole transmitter 33. The transducer 43 in turn generates electrical signals in response to the mud pressure variations and transmits such signals to the surface control unit 40. Alternatively, other telemetry techniques such as electromagnetic and/or acoustic techniques or any other suitable techniques known or hereinafter developed may be utilized. By way of example, hard wired drill pipe may be used to communicate between the surface and downhole devices. In another example, combinations of the techniques described may be used. As illustrated in FIG. 1, a surface transmitter receiver 80 communicates with downhole tools using, for example, any of the transmission techniques described, such as a mud pulse telemetry technique. This can enable two-way communication between the surface control unit 40 and the downhole tools described below.

According to aspects of this disclosure, the BHA 22 provides the requisite force for the bit 50 to break through the formation 46 (known as "weight on bit"), and provide the necessary directional control for drilling the borehole 26. In the embodiments illustrated in FIGS. 1 and 2, the BHA 22 may comprise a drilling motor 90 and first and second longitudinally spaced stabilizers 60 and 62. At least one of the stabilizers 60, 62 may be an adjustable stabilizer that is operable to assist in controlling the direction of the borehole 26. Optional radially adjustable stabilizers may be used in the BHA 22 of the steerable directional drilling system 10 to adjust the angle of the BHA 22 with respect to the axis of the borehole 26. A radially adjustable stabilizer provides a wider range of directional adjustability than is available with a conventional fixed diameter stabilizer. This adjustability may save substantial rig time by allowing the BHA 22 to be adjusted downhole instead of tripping out for changes. However, even a radially adjustable stabilizer provides only a limited range of directional adjustments. Additional information regarding adjustable stabilizers and their use in directional drilling systems can be found in U.S. Patent Application Publication No. 2011/0031023 A1, to Clive D. Menezes et al., which is entitled "Borehole Drilling Apparatus, Systems, and Methods" and is incorporated herein by reference in its entirety.

Figure 2:
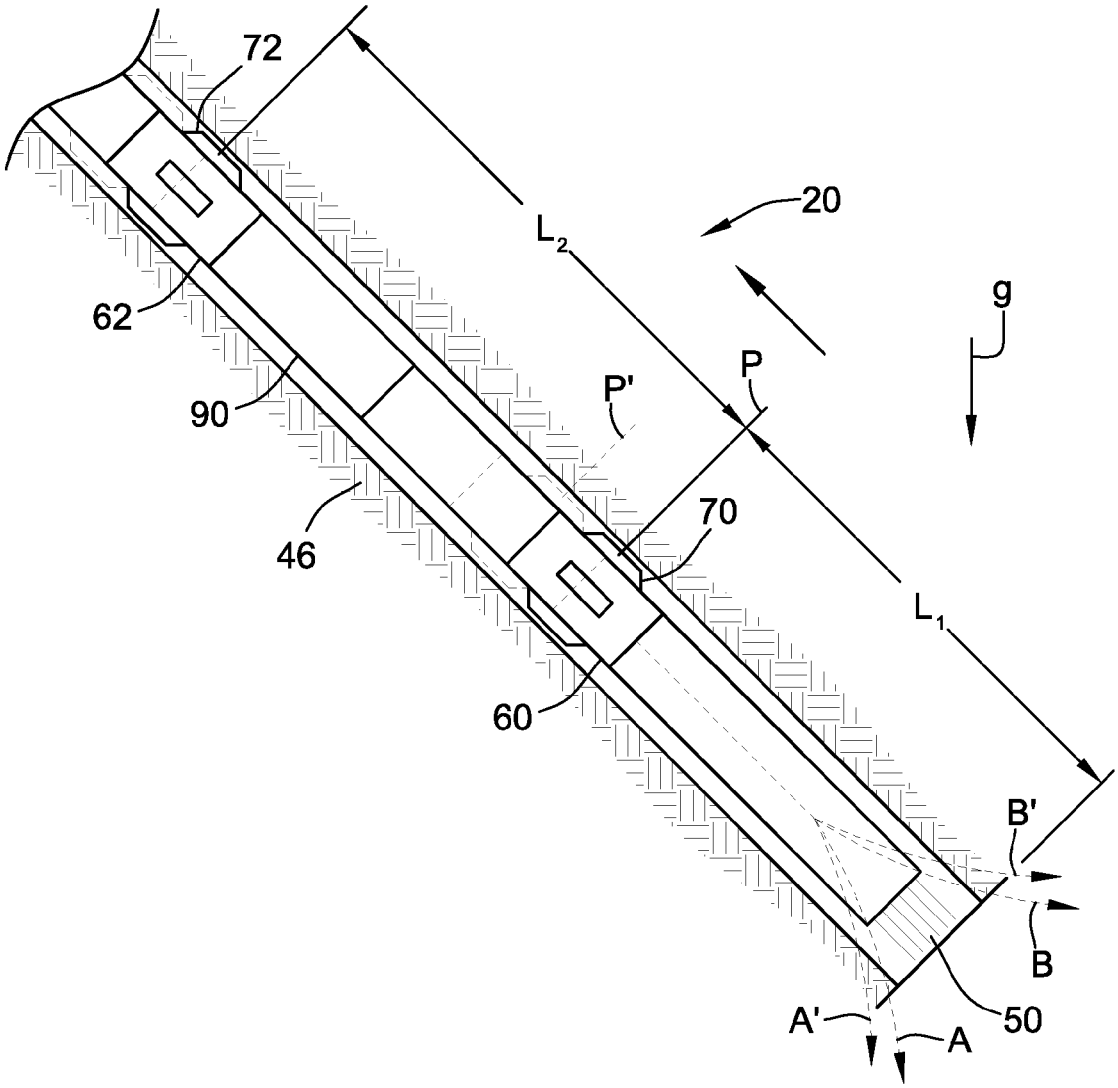
FIG. 2 is a schematic illustration of an exemplary bottom hole assembly (BHA) in accordance with aspects of the present disclosure.

As shown in the embodiment of FIG. 2, the distance between the drill bit 50 and the first stabilizer 60, designated as $L_1$, can be a factor in determining the bend characteristics of the BHA 22. Similarly, the distance between the first stabilizer 60 and the second stabilizer 62, designated as $L_2$, can be another factor in determining the bend characteristics of the BHA 22. Considering first stabilizer 60, the deflection at the drill bit 50 of the BHA 22 is a nonlinear function of the distance $L_1$, such that relatively small changes in $L_1$ may significantly alter the bending characteristics of the BHA 22. With radially movable stabilizer blades, a dropping or building angle, for example A or B, can be induced at bit 50 with the stabilizer at position P. By axially moving stabilizer 60 from P to P', the deflection at bit 50 can be increased from A to A' or B to B'. In accordance with some aspects of the disclosed concepts, a stabilizer having both axial and radial adjustment may substantially extend the range of directional adjustment, thereby saving the time necessary to change out the BHA 22 to a different configuration. In some embodiments the stabilizer may be axially movable. The position and adjustment of the second stabilizer 62 adds additional flexibility in adjusting the BHA 22 to achieve the desired bend of the BHA 22 to achieve the desired borehole curvature and direction. As such, the second stabilizer 62 may have the same functionality as the first stabilizer 60. While shown in two dimensions, proper adjustment of stabilizer blades may also provide three dimensional turning of BHA 22.

As used herein, "trajectory" generally refers to the path of a wellbore. "Position," as the term is used herein, generally refers to a position along the path of the wellbore, which may be referenced, for example, to some vertical and/or horizontal datum (usually the well-head position and elevation reference), or obtained using inertial measurement techniques. The term "azimuth," as used herein, generally refers to the directional angular heading (or "angular measurement") in a spherical coordinate system relative to a reference direction, such as North, at the position of measurement. In addition, the term "inclination" may be considered, for the present disclosure, to be the angular deviation of the borehole from vertical, usually with reference to the direction of gravity. "Measured depth," as used herein, generally refers to the distance measured from a reference surface location to a position along the path of the wellbore. By way of non-limiting example, measured depth may include the driller's depth, and it may also include depth correction algorithms, that account for the elastic stretching and compression of the drill string along its length.

Figure 3:
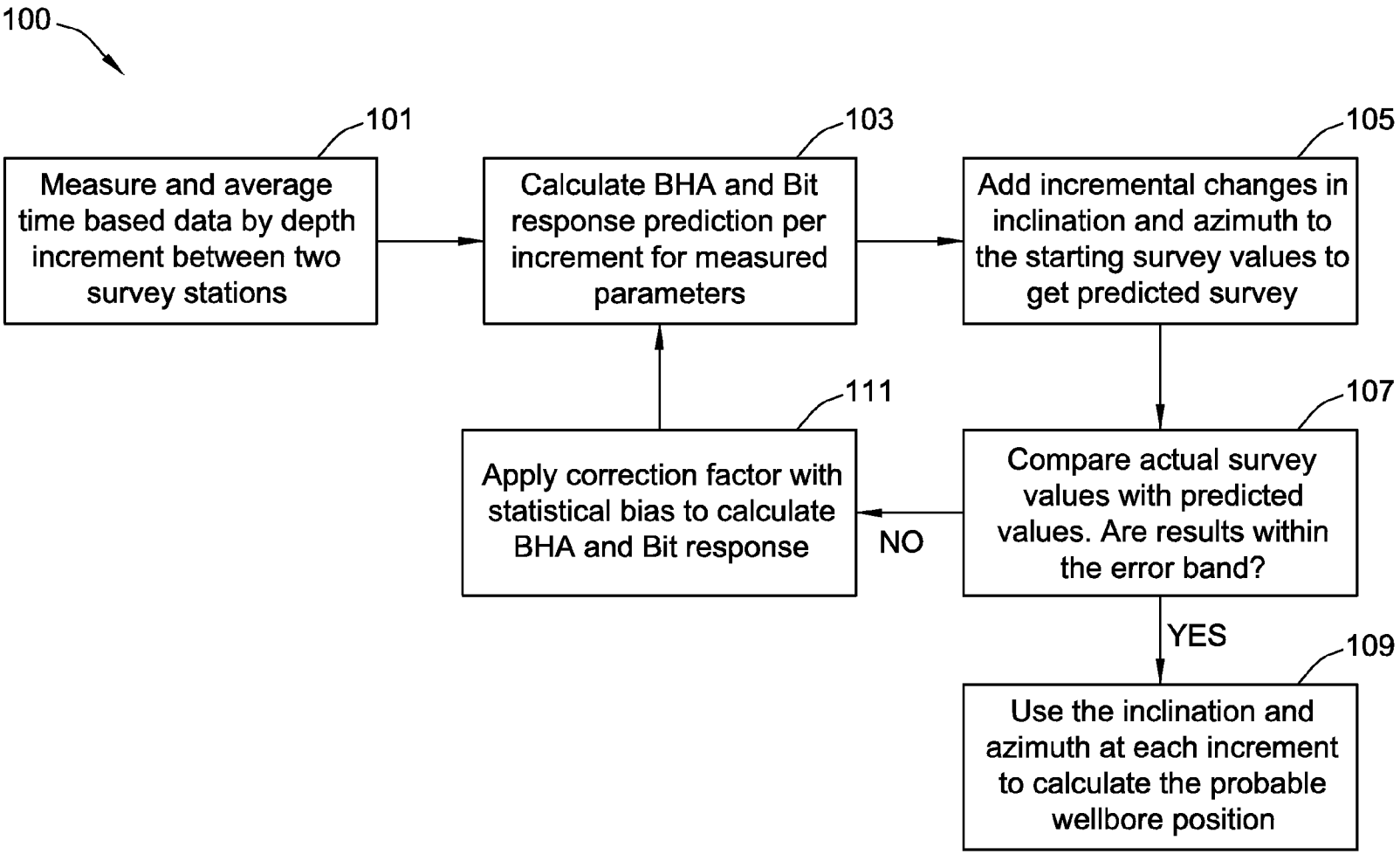
FIG. 3 is a flowchart representing an exemplary method or algorithm that corresponds to instructions that can be executed, for example, by a controller or processor in accordance with aspects of the present disclosure.

With reference now to the flow chart of FIG. 3, an improved method for determining a trajectory of a borehole is generally presented at 100 in accordance with aspects of the present disclosure. In some specific embodiments, the flow chart of FIG. 3 can be considered representative of a method or algorithm for dynamically building a predicted well path of a complex borehole between two survey points. FIG. 3 can additionally (or alternatively) represent an algorithm that corresponds to at least some instructions that can be stored, for example, in a memory device, and executed, for example, by a controller or processor, to perform any or all of the above or below described acts associated with the disclosed concepts. The memory device may comprise a computer program product with a non-transient computer readable medium having an instruction set borne thereby, the instruction set being configured to cause, upon execution by one or more controllers, any or all of the acts presented in FIG. 3.

In general, the method 100 starts by creating a theoretical model of the complex borehole geometry (also referred to herein as "predicted wellbore trajectory") at a first or "initial" survey station. For instance, at block 101, the method 100 of FIG. 3 includes receiving data indicative of one or more drilling parameters between at least two survey points (also referred to herein as "survey stations"). In some embodiments, a combination of surface and downhole sensors, such as sensors 48, 70, 72 of FIGS. 1 and 2, are used to measure and/or record a variety of drilling parameters between two survey stations. Each of the survey stations can be selected from amongst a number or "set" of survey points that are aligned, for example, generally equidistant from one another along the borehole trajectory. A survey station can be generated by taking measurements used for estimation of the position and/or wellbore orientation at a single position in the wellbore. In some non-limiting examples, these drilling parameters can include, singly and in any logical combination, measured depth, string rotary speed, weight on bit, downhole torque, surface torque, flow in, surface pressure, down hole pressure within the string, fluid density, downhole continuous inclination measurements, bit orientation (tool face), bit deflection, hole size, estimated bit wear, etc. Although well known in the art, some of these parameters are discussed below for additional clarity and ease of understanding; it should be understood, however, that the following explication is by no means limiting as the aspects of this disclosure are not limited to the parameters that follow nor their corresponding descriptions.

"Flow in," which comprises the measured rate of flow of fluid into the borehole, can alter the efficiency of the drilling process. For instance, the downhole tools can change their directional behavior due to a changing flow in rate. Moreover, the hole conditions can be altered by changing flow in rates. Correlating changes in flow rate to changes in the borehole path can enable a more accurate borehole path to be described by the model. This may include an iterative process to determine the correct model parameters that is constrained, at least in part, by the measured flow in value.

"Weight-on-Bit" (WOB), which comprises the amount of downward force exerted on the drill bit and is normally measured in thousands of pounds, can also alter the efficiency of the drilling process. The downhole tools can change their directional behavior due to a change in WOB. Similar to flow in, associating changes in WOB to borehole path changes enables a more accurate borehole path to be described by the model. This may also include an iterative process to determine the correct model parameters that is constrained, at least in part, by the measured WOB value.

The tool face settings (TF) comprise the directional setting of the downhole tool that describes the direction that the bend is facing as well as the degree of bend ("variable bend"). TF is therefore directly related to the borehole path and, thus, the wellpath will be altered in the direction of the TF.

Downhole (discrete) inclination and azimuth measurements, which is a setting of the downhole tool, describe the inclination and azimuth of the wellbore. Similar to TF, a downhole inclination measurement is a measurement of the borehole path and is therefore highly influential on the borehole path.

Downhole torque, which comprises the torque at the distal end of the drill string proximate the drill bit, can alter the efficiency of the drilling process. In a similar regard, surface torque, which comprises the torque at the uphole end of the drill string proximal the rotary table 14, can also alter the efficiency of the drilling process. Similar to changes in flow in and WOB, the downhole tools may change their directional behavior due to a change in downhole torque and/or uphole torque. Correlating changes in torque to the changes in the borehole path enables a more accurate borehole path to be generated by the model. This may include, for example, an iterative process to determine the correct model parameters that is constrained, at least in part, by the measured downhole torque value and/or the measured uphole torque value.

Downhole pressure within the string can also alter the efficiency of the drilling process because the downhole tools may change their directional behavior due to variations in downhole pressure. Downhole pressure, in some embodiments, is measured at the drilling tool, e.g., the mud motor, drill bit, or both. Fluid density of the "mud" is another drilling parameter that can alter the efficiency of the drilling process by potentially altering the directional behavior of the downhole tools. A more accurate borehole path can be described by correlating changes in downhole pressure and/or fluid density to borehole path changes. This may comprise, for example, an iterative process to determine the correct model parameters that is constrained, at least in part, by the measured downhole pressure value. Hole size and estimated bit wear, which is directly related to hole size, can also affect directional tool performance and particularly the measurement of the amount of sag (or bend) in the BHA.

With continuing reference to the method 100 of FIG. 3, block 101 also includes averaging the received data over predetermined increments between the two survey points. The data may comprise time-based measurements of the drilling parameters, which are taken by a predetermined depth increment. In some embodiments, each predetermined increment is set to a user defined depth increment. To that end, the data can then be averaged over the user defined depth increment, which may be entered or selected, for example, via input device 44, and typically would include preset selectable options, such as 30 m, 15 m and 10 m (approx), but could be reduced to depths as small as 1 m for high dogleg intervals. Other depth increments are certainly envisioned without departing from the intended scope and spirit of the present disclosure. By way of explanation, and not limitation, information related to the drilling parameters may be measured and recorded on a second-by-second basis over small depth increments between the two survey stations, e.g., every six inches or every foot or every meter. The corresponding time and depth intervals may depend on how fast the drill string 20 is drilling—for example, at 60 feet per hour (fp·hr), 30 seconds of data is taken for a six-inch depth increment, which is subsequently averaged. Comparatively, if the drill string 20 is drilling at 10 fp·hr, the time interval may be larger and/or the depth interval may be smaller, which would result in a significantly larger data set, which is subsequently averaged. In some embodiments, the faster the drill string is drilling, the smaller the data set; conversely, the slower the drill string is drilling, the larger the data set. It may also be desirable to take the highest data density available; however, this may be restricted, for example, due to practical limitations, such as memory limitations. In addition, the data set can be filtered before averaging. For instance, in some applications, only data points that fall within one-sigma (or two-sigma, three-sigma, etc.) of deviation are included in the data set. The end result of block 101 may comprise identifying a manageable value for each of the drilling parameters to a user defined depth increment.

At block 103 of FIG. 3, a predicted drill string response for each of the predetermined increments is calculated from the averaged drilling parameter data accumulated at block 101. A predicted drill string response can be calculated for each of the individual drilling parameters. In some embodiments, the predicted drill string response includes both a predicted BHA response and a predicted drill bit response. Aspects of the present disclosure include using a suitable method, such as the Sperry Drilling MaxBHA™ Drilling Optimization Software, the Drill Bits & Services Direction by Design™ Software, or the Landmark Wellplan™ BHA Software, all of which are available from Halliburton Energy Services, Inc., to calculate the drilling system and bit response for the measured parameters to determine the change in inclination and azimuth over each increment. Additional information regarding the MaxBHA™ modeling software, which can be used to calculate drill string response, is provided by D. C. Chen and M. Wu, "State-of-the-Art BHA Program Produces Unprecedented Results," IPTC 11945 (2008), which is incorporated herein by reference in its entirety. From the predicted drill string response changes in both the inclination and the azimuth of the trajectory can be calculated for each user defined depth increments.

MaxBHA™ provides a two dimensional static model. In general, the 3-dimensional response of the BHA is not directly calculated. Rather, MaxBHA™ typically models the response of the BHA only in the vertical plain. From that result, the response of the BHA in three dimensions can be inferred. MaxBHA™ considers the BHA components in either a straight wellbore or a constant curve, and contains models to predict the response of the rotary steerable tools. By way of comparison, Wellplan™BHA DrillAhead Software has two components: first, a nonlinear 3-D finite element analysis (FEA) technology is used to solve the structural problem of a confined BHA; and, second, a combination of analytical methods and rules is used to determine the drilling tendencies of the assembly. This approach can generally be considered a better system to use to solve the BHA response in a complex wellbore. However, the current Wellplan™BHA software does not contain a model for the rotary steerable tools used in the example and has distance limitations on the FEA model.

The changes in inclination and azimuth are used to generate a predicted wellbore trajectory, as indicated in block 105. In some embodiments, the starting survey values are stationary survey values (e.g., taken at a single point) of the measured depth, inclination and azimuth. For example, the sum of the incremental changes in inclination and azimuth can be added to starting survey values to create a predicted wellbore trajectory at the first survey station. In an iterative approach, the predicted wellbore trajectory can be subsequently updated, systematically or indiscriminately, with additions of changes in inclination, azimuth, measured depth, and any logical combination thereof.

At this stage, the method 100 of FIG. 3 determines whether the predicted wellbore trajectory is satisfactory. For instance, at block 107, the predicted wellbore trajectory is compared to a measured wellbore trajectory, which is determined, in some embodiments, at the second survey station. This comparison, according to aspects of the present disclosure, is to determine whether the difference between the predicted wellbore trajectory and the measured wellbore trajectory are within a predetermined error band. The error band can depend, for example, on the type of mathematical error model being applied to determine what is "mathematically acceptable." In a non-limiting example, one acceptable error model that can be employed is disclosed by H. S. Williamsom, in "Accuracy Prediction for Directional Measurement While Drilling," SPE Drill & Completion Vol. 15, No. 4 (December 2000), which is incorporated herein by reference in its entirety. If the comparison is favorable (i.e., block 107=YES), a probable borehole position is determined or otherwise identified from the change in inclination and azimuth for each of the predetermined increments, as indicated at block 109. Current practice is to create a single curve to model the borehole trajectory between two survey points. In contrast, the predicted wellbore trajectory is, in some embodiments, a summation of discrete changes over a small distance, thus comprising a series of curves. By way of non-limiting example, if the typical survey distance is 19 feet and measurements are taken every six inches, 180 small curves are built to generate a well bore position. In other words, the methods of the present disclosure comprise building a complex model of the wellbore geometry between the two survey stations instead of a simple single-curve model.

If the predicted values identified in block 105 are significantly different from the measured values at the second survey station, as determined at block 107, a correction factor can be applied and the predicted values recalculated. For example, in block 111, if the comparison is not favorable (i.e., block 107=NO), a statistical bias can be applied to a correction factor. The predicted drill string response is contemporaneously recalculated by applying the correction factor with the statistical bias. In some situations, for example, soft formations around a bottom hole assembly would increase inclination more slowly when steering to increase inclination (and would lose inclination more quickly on a reciprocal setting) than the base model estimates. A statistical bias can be determined (e.g., using probability algorithms) and used to generate a correction factor to offset such a scenario. Optionally, the correction can be applied to the portion of the well between the survey instrument and the bit to give a better prediction of the wellbore position at the bit. In some embodiments, the foregoing is iterated—i.e., the steps set forth in blocks 103, 105, 107 and 111 are repeated, until the predicted inclination and azimuth are within the acceptable error range from the measured values.

Figure 4:
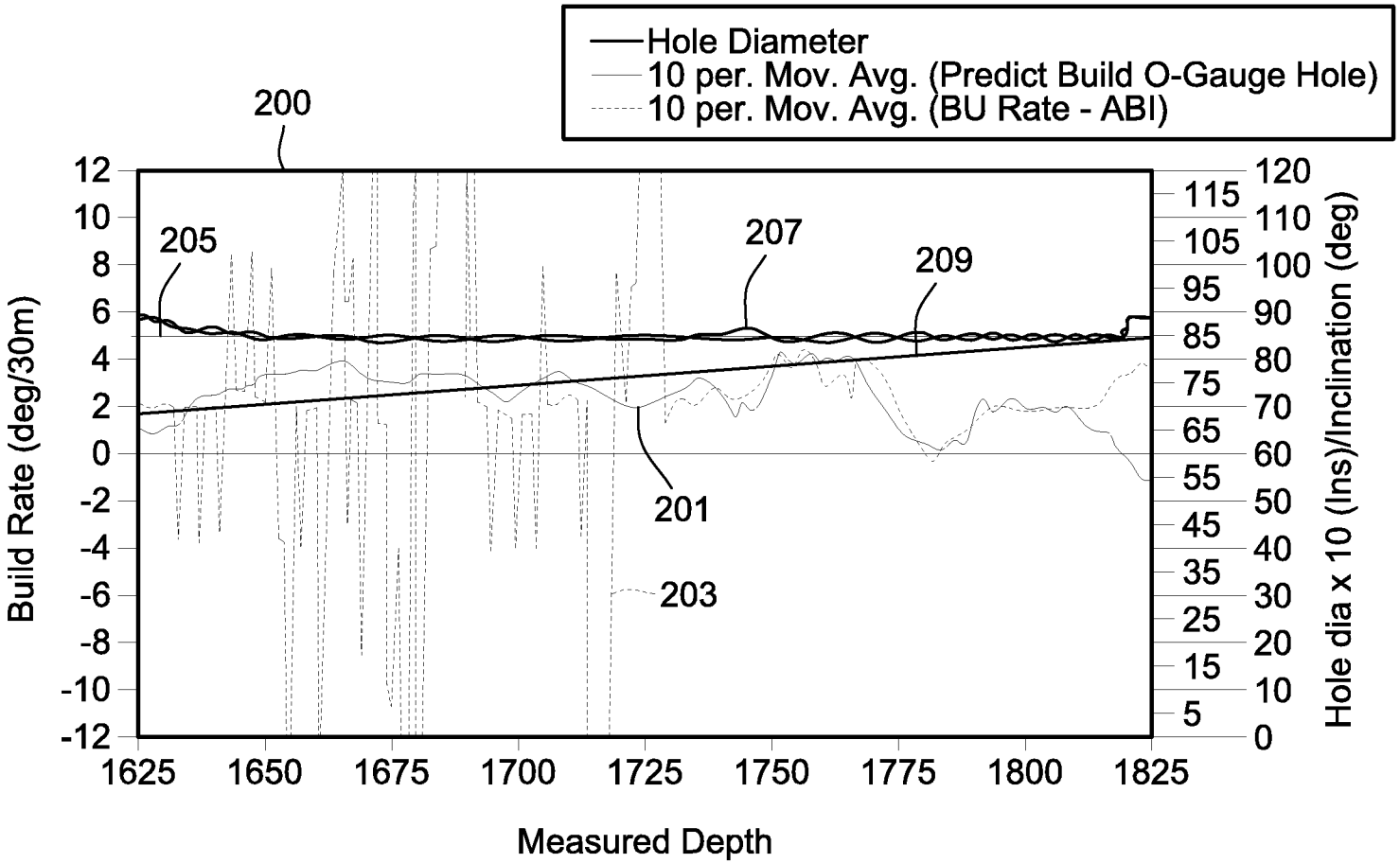
FIG. 4 is a graph illustrating at various measured depths the calculated build rate for an exemplary rotary steerable assembly and the calculated build rate using an exemplary near bit inclination sensor.

Turning next to FIG. 4, a graph 200 is shown illustrating, at various measured depths, the predicted build rate for an exemplary rotary steerable assembly and the calculated build rate using an exemplary near bit inclination sensor. An exemplary predicted value for the build rate, which can be determined using the MaxBHA™ Drilling Optimization Software, is indicated at 201. The calculated buildup rate generated using information from a sensor in a rotary tool is indicated at 203. Recognizing that the hole diameter affects BHA response, line 205 designates a reference hole diameter (8.5 inches in FIG. 4), and line 207 indicates the hole diameter as measured by downhole sensors. The inclination, as measured by a main survey instrument, is indicated at line 209. As can be seen in FIG. 4, the predicted buildup rate indicated at 201 is similar to the calculated (measured) buildup rate indicated at 203. However, the variation in buildup rate in the calculated buildup rate 203 is significantly larger than the variation in the predicated (measured) buildup rate 201, as seen in FIG. 4. Consequently, an advantage to employing the predicated (measured) buildup rate 201 is that it is less prone to interference created, for example, by vibrations generated during drilling. When trying to accurately measure changes in trajectory, drilling vibrations affect the actual position of the sensor (moving due to vibrations), which in turn affects the accuracy of the measurements.

A further embodiment of this disclosure includes calculating the misalignment of the directional survey tool within the borehole at both the first and second survey stations. During the course of drilling a borehole, the azimuth and inclination of the borehole can be measured along with the borehole depth in order to determine the borehole trajectory and to directionally guide the borehole to a subsurface target. The survey tool, which can be located within a drill collar of the BHA, measures the direction and magnitude of the local gravitational and magnetic fields. Measurements of the earth's magnetic and gravitational fields can be used to estimate the azimuth and inclination of the borehole at a particular point or points of measurement. A static survey can be taken each time drilling operations are interrupted to add a new section or sections of drillpipe to the drill string. The azimuth and inclination data may be obtained using conventional survey instruments, and transmitted to the surface using known telemetry methods.

The misalignment can be calculated by modeling the BHA attitude within the complex borehole as described in the process above (e.g., FIG. 3). For example, once a 3-D mathematical model of the complex wellbore is generated, the method may further include determining how the drill string assembly will fit in that complex wellbore, where are the contact points, and what is the misalignment between the survey instrument and the well bore. The survey misalignment is known as "sag." Generally speaking, the long, tubular drill string assembly may deform due to gravity. If the survey instrument is within a "sagging" segment of the drill string assembly, the survey instrument is misaligned in relation to the well bore due to the sag in the tubular. That misalignment is therefore taken into account and used to correct the actual survey. This correction can be calculated, in some embodiments, with a wellbore trajectory measured with a GPS navigation system.

Historically, the calculation of sag correction of a tool in a borehole shape is based on the minimum curvature model. In this embodiment, however, the modeling can take into account various factors that are not accounted for in the minimum curvature model, including one or more of the following: complex geometry and stiffness of the bottom hole assembly; complex geometry of the borehole as described by the predicted inclination and azimuth in the embodiment of FIG. 3; and, borehole size (e.g., diameter) and shape (e.g., as described by a caliper log).

Optionally, the predicted inclination and azimuth can then be recalculated between the first and second survey stations based on the new sag corrected survey stations. As another option, embodiments may include calculating the misalignment of the directional survey tool within the borehole while using continuous survey measurements taken while drilling to describe the borehole geometry. Another option includes correcting continuous inclination and azimuth measurements taken while drilling using the methods described above for calculating the misalignment of the directional survey tool within the borehole.

Aspects of this disclosure can also be used as a method of historically examining previously drilled wells that have no continuous survey data, and recalculating the wellbore position with increased accuracy. Potentially, this could have significant commercial application for fields were TVD uncertainty have been an issue in landing out horizontal wells in the correct target. Correcting nearby offset wells would reduce the uncertainly for landing the new well and could potentially improve reservoir volume calculations.

The various aspects of the present disclosure may be implemented, in some embodiments, through a computer-executable program of instructions, such as program modules, generally referred to as software applications or application programs executed by a computer. The software may include, in non-limiting examples, routines, programs, objects, components, and data structures that perform particular tasks or implement particular abstract data types. The software forms an interface to allow a computer to react according to a source of input. The software may also cooperate with other code segments to initiate a variety of tasks in response to data received in conjunction with the source of the received data. The software may be stored on any of a variety of memory media, such as CD-ROM, magnetic disk, bubble memory, and semiconductor memory (e.g., various types of RAM or ROM). Furthermore, the software and its results may be transmitted over a variety of carrier media, including wire, fiber optics, WiFi, Internet, free space, and combinations thereof.

Moreover, the numerous aspects of the present disclosure may be practiced with a variety of computer-system and computer-network configurations, including hand-held devices, multiprocessor systems, microprocessor-based or programmable-consumer electronics, minicomputers, mainframe computers, and the like. In addition, aspects of the present disclosure may be practiced in distributed-computing environments where tasks are performed by remote-processing devices that are linked through a communications network. In a distributed-computing environment, program modules may be located in both local and remote computer-storage media including memory storage devices. Aspects of the present disclosure may therefore, be implemented in connection with various hardware, software or a combination thereof, in a computer system or other processing system.

While particular embodiments and applications of the present disclosure have been illustrated and described, it is to be understood that the present disclosure is not limited to the precise construction and compositions disclosed herein and that various modifications, changes, and variations can be apparent from the foregoing descriptions without departing from the spirit and scope of the invention as defined in the appended claims.

What is claimed is:

1. A method for determining a trajectory of a borehole generated by a directional drilling system having one or more sensing devices operatively connected to a drill string with a steerable downhole assembly and a rotatable drill bit, the method comprising:

receiving, from at least one of the one or more electronic sensing devices operatively connected to the drill string, data indicative of one or more drilling parameters between at least two survey points;

averaging, via at least one of one or more controllers, the received data over predetermined increments between the at least two survey points;

calculating, via at least one of the one or more controllers from at least the averaged data, a predicted drill string response for each of the predetermined increments;

determining, via at least one of the one or more controllers from at least the predicted drill string response, a change in inclination and azimuth for each of the predetermined increments;

generating, via at least one of the one or more controllers, a predicted wellbore trajectory from at least the change in inclination and azimuth;

comparing, via at least one of the one or more controllers, the predicted wellbore trajectory to a measured wellbore trajectory;

if the comparison is favorable, determining, via at least one of the one or more controllers, a probable borehole position from at least the change in inclination and azimuth for each of the predetermined increments; and storing, via at least one of one or more memory devices, a representation of the predicted wellbore trajectory and the probable borehole position.

2. The method of claim 1, wherein the comparison being favorable includes a difference between the predicted wellbore trajectory and the measured wellbore trajectory being within a predetermined error band.

3. The method of claim 1, further comprising:

if the comparison is not favorable, recalculating the predicted drill string response by applying a correction factor with a statistical bias.

4. The method of claim 3, wherein the recalculating, the determining, the generating, and the comparing are reiterated until the comparison is favorable.

5. The method of claim 1, wherein the predicted wellbore trajectory is determined at a first of the at least two survey points, and the measured wellbore trajectory is determined at a second of the at least two survey points.

6. The method of claim 1, wherein the steerable downhole assembly includes a bottom hole assembly (BHA) with the drill bit rotatably coupled to a downhole end of the BHA, and wherein the predicted drill string response includes a predicted BHA response and a predicted drill bit response.

7. The method of claim 1, wherein the received data includes time-based measurements of the one or more drilling parameters taken by depth.

8. The method of claim 1, further comprising:

receiving a user defined depth increment, wherein each of the predetermined increments is substantially equal to the user defined depth increment.

9. The method of claim 1, wherein the received data is indicative of a plurality of the drilling parameters, the method further comprising:

calculating the predicted drill string response for each of the drilling parameters.

10. The method of claim 1, further comprising:

calculating a misalignment of a directional survey tool within the borehole at both of the at least two survey points.

11. The method of claim 10, wherein the calculating the misalignment is based, at least in part, upon at least one of a complex geometry and a stiffness of the BHA, a complex geometry of the borehole, and a borehole size and shape.

12. The method of claim 10, further comprising:

recalculating the change in inclination and azimuth for each of the predetermined increments based, at least in part, upon the misalignment of the directional survey tool.

13. The method of claim 10, wherein the calculating the misalignment is based, at least in part, upon continuous survey measurements taken while the drill string is drilling.

14. The method of claim 1, wherein the one or more drilling parameters include measured depth, string rotary speed, weight on bit, down hole torque, surface torque, flow in, surface pressure, down hole pressure, fluid density, down hole continuous inclination measurements, bit orientation, bit deflection, hole size, or estimated bit wear, or any combination thereof.

15. A computer program product for determining a trajectory of a borehole generated by a directional drilling system having one or more sensing devices operatively connected to a drill string with a steerable downhole assembly and a rotatable drill bit, the computer program product comprising a non-transient computer readable medium having an instruction set borne thereby, the instruction set being configured to cause, upon execution by one or more controllers, the acts of:

averaging a measured data set over predetermined increments between at least two survey points, the data set being indicative of at least one of a plurality of drilling parameters measured by at least one of the one or more electronic sensing devices operatively connected to the drill string;

calculating from at least the averaged data set a predicted drill string response for each predetermined increment;

determining from at least the predicted drill string response a change in inclination and azimuth for each predetermined increment;

generating a predicted wellbore trajectory from at least the change in inclination and azimuth;

comparing the predicted wellbore trajectory to a measured wellbore trajectory;

if the comparison is not favorable, recalculating the predicted drill string response by applying a correction factor with a statistical bias, and reiterating the acts of determining, generating, and comparing;

if the comparison is favorable, determining a probable borehole position from the change in inclination and azimuth for each predetermined increment; and storing in at least one of one or more memory devices a representation of the predicted wellbore trajectory and the probable borehole position.

16. A system for predicting a path of a complex borehole drilled by a directional drilling system having at least one sensing device operatively connected to a drill string with a bottom hole assembly (BHA) and a drill bit, the system comprising:

an input device configured to receive an input from a user;

a controller;

a memory device storing a plurality of instructions which, when executed by the controller, cause the controller to:

receive from the at least one sensing device measurements indicative of a plurality of drilling parameters between first and second survey points;

average the received measurements over each of a plurality of user-defined depth increments between the first and second survey points;

calculate from at least the averaged measurements a predicted BHA response and a predicted drill bit response for each of the depth increments;

determine from at least the predicted BHA response and the predicted drill bit response a change in inclination and azimuth for each of the depth increments;

generate a predicted wellbore trajectory at the first survey point from at least the change in inclination and azimuth;

compare the predicted wellbore trajectory to a measured wellbore trajectory at the second survey point; and if the comparison is favorable, determine a probable borehole position from the change in inclination and azimuth for each of the depth increments.

17. The system of claim 16, wherein the memory device further stores an instruction to:

if the comparison is not favorable, recalculate the predicted drill string response by applying a correction factor with a statistical bias; and reiterate the instructions to determine, generate, and compare until the comparison is favorable.

18. The system of claim 17, wherein the comparison being favorable includes a difference between the predicted wellbore trajectory and the measured wellbore trajectory being within a predetermined error band.

19. The system of claim 16, wherein the measurements include time-based measurements of the plurality of drilling parameters taken by depth.

20. The system of claim 16, wherein the memory device further stores an instruction to:

calculate the predicted BHA response and the predicted drill bit response for each parameter in the plurality of drilling parameters.

* * * * *